United States Patent [19]

Wiegner

[11] 4,103,772

[45] Aug. 1, 1978

[54] SEALED CONTAINER WITH FRANGIBLE PARTITION

[76] Inventor: Georg Wiegner, Breslauer Str. 35, Viersen 11, Fed. Rep. of Germany, 4060

[21] Appl. No.: 720,154

[22] Filed: Sep. 3, 1976

[30] Foreign Application Priority Data

Sep. 4, 1975 [DE] Fed. Rep. of Germany ..... 2539291

[51] Int. Cl.[2] ..... B65D 25/08

[52] U.S. Cl. ..... 206/222

[58] Field of Search ..... 206/219, 222, 498; 215/DIG. 8; 222/81, 83, 85; 259/48, DIG. 20

[56] References Cited

U.S. PATENT DOCUMENTS

| | | | |
|---|---|---|---|
| 2,631,521 | 3/1953 | Atkins, Jr. | 206/222 X |
| 2,653,611 | 9/1953 | Smith | 206/222 X |
| 2,773,591 | 12/1956 | Jensen | 206/222 X |
| 3,347,410 | 10/1967 | Schwartzman | 206/222 X |
| 3,349,966 | 10/1937 | Schwartzman | 206/222 X |
| 3,521,745 | 7/1970 | Schwartzman | 206/222 |
| 3,548,562 | 12/1970 | Schwartzman | 206/222 X |
| 3,687,076 | 8/1972 | Friant et al. | 206/222 X |
| 3,970,068 | 7/1976 | Sato | 206/219 X |

FOREIGN PATENT DOCUMENTS

| | | | |
|---|---|---|---|
| 2,211,753 | 9/1972 | Fed. Rep. of Germany | 206/222 |

*Primary Examiner*—Steven E. Lipman
*Attorney, Agent, or Firm*—Hans Berman

[57] ABSTRACT

A disposable container for a two-part composition whose plastic shell defines a cavity. A frangible partition of coated aluminum foil divides the cavity into two sealed compartments. A piercing member mounted on a resilient portion of the shell in one compartment has a free end portion transversely directed toward the partition. It pierces the partition when the resilient shell portion is pushed manually inward of the cavity, and the contents in the one compartment may then be pumped into the other compartment by alternatingly pressing and relaxing the resilient shell portion.

8 Claims, 3 Drawing Figures

SEALED CONTAINER WITH FRANGIBLE PARTITION

This invention relates to containers in which individually durable components of a short-lived mixture may be stored for an extended period, and thereafter mixed while protected from the atmosphere. More specifically, the invention relates to a storing and mixing container for a two-component system of which at least one component is a liquid.

Containers suitable for storing separately the components of a mixture having a limited useful life are used in many fields, and the invention will be described hereinbelow with specific reference to a container for a cosmetic article, such as a hair coloring composition, although other applications will readily come to mind. For the specific application in which the invention has found its first practical use, it is important that the sealed container permit its contents to be mixed and dispensed thereafter at a precisely controlled rate using one hand only.

Known containers permit efficient mixing only when at least one component is a free-flowing powder or a liquid of low viscosity which will readily flow by gravity from one compartment of the container into another compartment when a partition between the compartments is broken. It is a primary object of this invention to provide a container of the type described which may be employed for storing and mixing liquid components so viscous as to flow very slowly under the force of gravity alone, or even not capable of flowing by gravity through narrow passages.

With this object and others in view, the invention provides a container whose shell defines a cavity divided into a first compartment and a second compartment sealed from the first compartment by a frangible partition. A piercing thorn is mounted on a portion of the shell in one compartment and has a free end portion directed toward the partition in a direction transverse to the partition. The shell portion carrying the piercing thorn is resiliently movable inward of the cavity in this transverse direction a distance sufficient to cause piercing of the partition by the thorn when the shell portion is moved. The components thereafter mixed may be released from the shell when a spout directly connecting the first compartment to the surrounding atmosphere is open.

Other features, additional objects, and many of the attendant advantages of this invention will readily be appreciated as the same becomes better understood from the following detailed description of preferred embodiments of the invention when considered in connection with the appended drawing in which.

Figure 1:
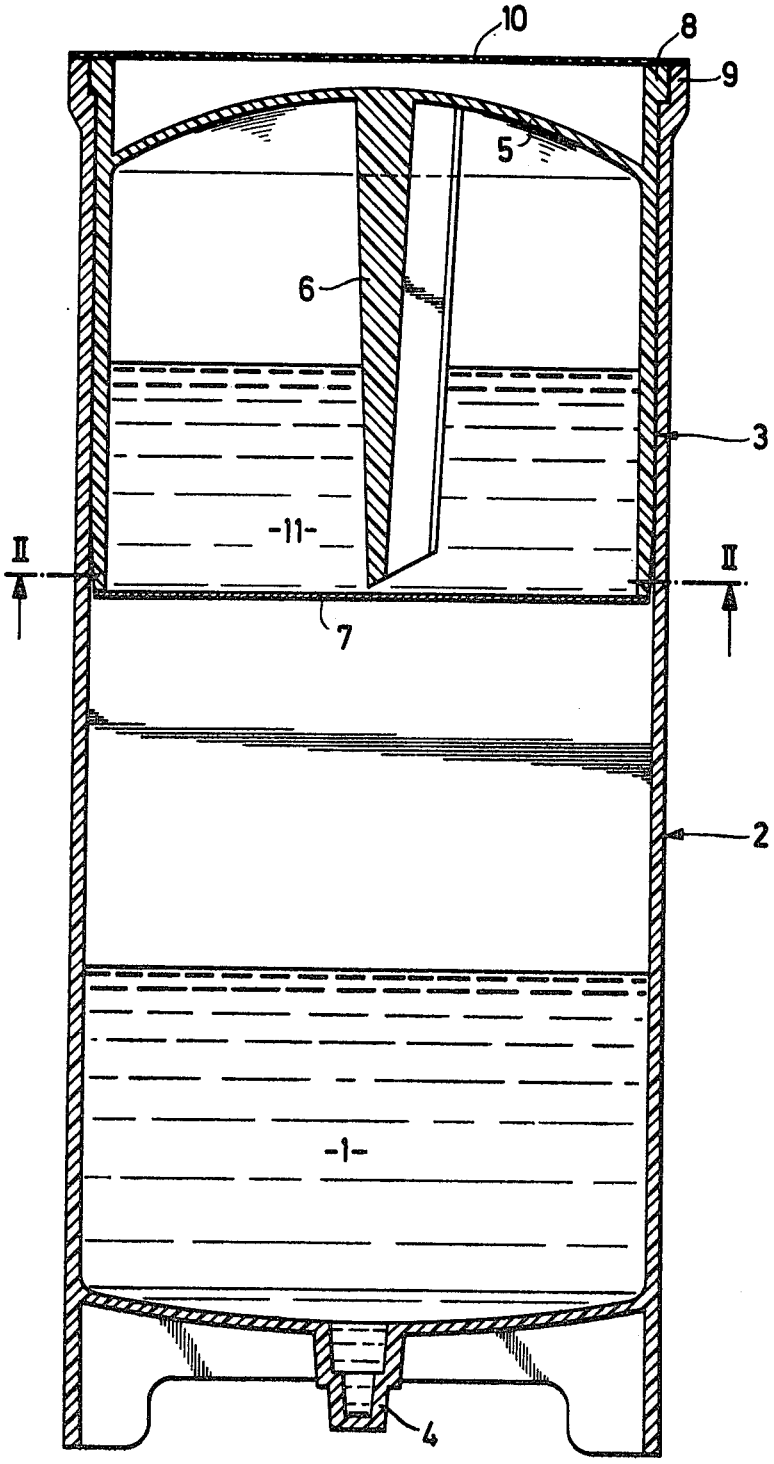
FIG. 1 shows a container of the invention in elevational section.

Referring now to the drawing in detail, and initially to FIG. 1, there is shown a container of the invention whose two main parts 2, 3 have each the shape of a prismatic cup with a dished bottom wall and four side walls projecting outward beyond the bottom wall. The cups are injection-molded from suitable plastic material, and the bottom wall of the part 2 is provided with a central, integrally sealed nipple 4.

The height of the smaller, cup-shaped part 3 is approximately one third of that of the part 2, and its outer cross section is about equal to the inner cross section of the larger part 2 so that the smaller part 3 may be inserted in the illustrated inverted position into the cavity of the larger container part 2 with a snug fit. In the inserted position of the smaller part 3, an annular flange 8 extending about the side walls near its dished bottom wall 5 is received in a mating groove of an annular flange 9 which extends around the open side of the larger part 2 and is flush with the flange 8.

A flat aluminum foil 10 is sealed to the flanges 8, 9 outside the container cavity. Another flat aluminum foil 7, parallel to the foil 10, closes the downwardly directed open side of the smaller container part 3. Both aluminum foils 7, 10 are plastic-faced and heat-sealed to the associated, annular edge portions of the container parts 2, 3.

A piercing thorn 6 centrally depends from the concave face of the dished bottom wall 5. As is better seen in FIG. 2, the thorn is V-shaped in cross section, and it tapers to cutting edges which meet in a point directed toward the center of the foil 7. The synthetic resin composition which constitutes the container part 3, including its bottom wall 5 and the integral piercing thorn 6, and the dimensions of the several components of the unitary plastic structure are selected in such a manner that the thorn is rigid enough to pass through the foil 7 without difficulty when a thumb applied from the outside to the foil 10 fractures the foil and deflects the bottom wall 5 inward of the contained cavity. The synthetic resin composition may be flexible enough to permit deformation of the bottom wall 5 if all walls of the part 3 are of equal thickness, or the bottom wall 5 may be thinner than other container walls, for example 0.5 mm thick, as compared to 1 – 2 mm for the side walls.

In assembling the container, the parts 2, 3 are set up with their open sides up, and are partly filled with liquids 1, 11 respectively. The container part 3 then is sealed by means of the foil 7 which is readily heated by induction to fuse its plastic coating to the edge of the part 3. The latter then is inverted and inserted in the container part 2 so that the foil 7 constitutes a partition sealing from each other the two compartments of the container cavity corresponding to and defined by the parts 2, 3, and the flanges 8, 9 are heat-sealed to each other and to the foil 10 by induction heating of the foil.

The foil does not afford strong protection to the bottom wall 5, but it gives a visual indication of the condition of the partition 7 which remains intact as long as the foil 10 is securely attached to the flanges 8, 9 and unbroken.

When the contents of the container are about to be used, pressure of a finger may be sufficient to break the foil 10 and to depress the bottom wall 5 in a single movement while the other fingers of the same hand are wrapped about the side walls of the larger container part. The liquid 11, even if very viscous, can be transferred to the lower compartment bounded by the larger container part 2 and the punctured foil 7 by alternatingly depressing and relaxing the bottom wall 5. When all ingredients are received in the lower compartment, they may be mixed by shaking, and a bearing ball of chemically resistant metal, not illustrated but conventional, may be introduced into the container part 2 with the liquid 1 to hasten mixing if both components 1, 11 are very viscous.

When the mixture can be assumed to be sufficiently homogeneous, the closed end of the nipple 4 is cut off, and the spout so produced will discharge the fluid contents of the container at a rate precisely controlled by pressure applied to the bottom wall 5 or to other sufficiently flexible portions of either container part 2, 3.

Figure 3:
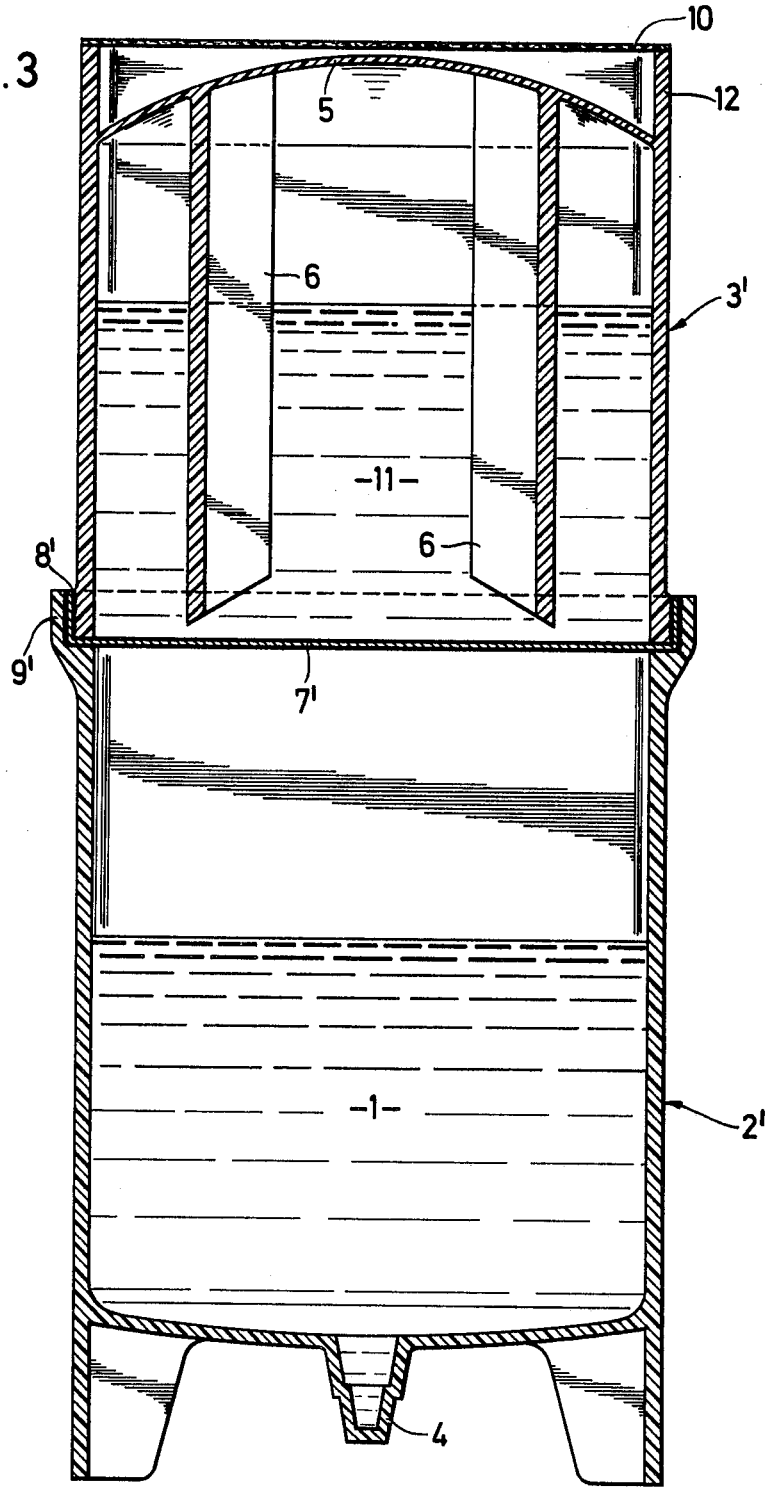
FIG. 3 shows a modification of the container of FIG. 1 in a corresponding view.

One of the modifications of the afore-described container which may suggest themselves to those skilled in the art on the basis of the above teachings is shown in FIG. 3. The modified container has two cup-shaped parts 2', 3' respectively bounding compartments for the two components 1, 11. The two parts are of generally equal, rectangular cross section and have dished bottom walls whose concave faces are directed toward the container cavity.

The annular edge portion 8' of the container part 3' is received in a groove of an annular flange 9' extending about the open side of the container part 2'. The edges of an otherwise planar plastic-faced aluminum foil or membrane 7' are mechanically secured in the groove of the flange 9' by the edge portion 8' and fastened to each other by fusing of the plastic coating on the foil to the synthetic resin composition of the two container parts, as by induction heating.

Two thorns 6 not significantly different from the single thorn described above with reference to FIGS. 1 and 2 depend from the concave face of the bottom wall 5 which closes the compartment in the container part 3' in an upward direction when the container is in the illustrated position. The sharp points of the thorns 6 are located closely adjacent the foil 9' when the bottom wall 5 is relaxed, and pierce the foil 7' when the bottom wall 5 is resiliently deflected inward of the container cavity. They are withdrawn by the resiliency of the bottom wall from the openings formed in the foil when the pressure on the bottom wall is relaxed, and the bottom wall reverts to the illustrated position. The air pressure acting on the liquid 11 can be raised by pressing on the convex outer face of the bottom wall 5, and the liquid 11 thereby caused to flow into the liquid 1 in the container part 2'. The thorns 6 entering the openings formed in the foil 7' further contribute to the transfer of the liquid 11.

A flat foil 10 of aluminum is attached to the annular edge portions 12 of the container side walls which project beyond the convex face of the bottom wall 5 to indicate the condition of the partition constituted by the foil 7, as described above, and the mixture formed in the container part 2' may be released from the spout constituted by an initially sealed nipple 4 on the bottom wall of the container part 2'.

Figure 2:
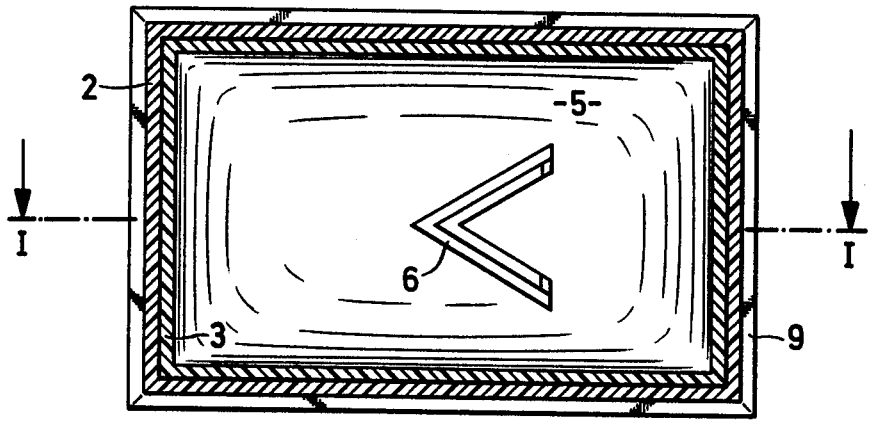
FIG. 2 illustrates the container of FIG. 1 in section on the line II—II.

The illustrated embodiments of the invention are dimensioned to fit into a user's hand, and the two components separated from each other by the partition 7, 7' may be mixed by means of one hand, and discharged by one hand after the nipple 4 is opened. For applications other than the treatment of human hair, containers of different dimensions may be built from materials of construction other than those specifically referred to above in an obvious manner. The rectangular container cross section specifically shown in FIG. 2 is preferred for a small, hand-held container because of the firm grip of a human hand on a container of angular shape, but may not be advantageous in different applications.

The edge-to-edge connection of the container parts illustrated in FIG. 3 is preferred when the two parts must be made of different materials to resist attack by the liquids 1, 11 respectively over an extended period. Glass and metals may be combined with each other or with plastics in making the container parts 2',3', and the material of the frangible partition 7' may be chosen accordingly. The foil or membrane 10 may be made of any frangible sheet material regardless of the nature of the liquids 1, 11, and is advantageous when the entire contents of the container are to be dispensed in a single operation or over a short span of time. If the mixture prepared in the container has a useful life of a few days, or even a few hours, the membrane 10 may be dispensed with altogether. The normally sealed nipple 4 is most practical if the entire contents of the container are to be used up within a few minutes. It may be sealed for later use by a cap in a conventional manner, not shown, but other known closures may be substituted.

Other modifications will readily suggest themselves for specific applications. The containers described and illustrated are eminently suitable for storing hydrogen peroxide solution and a coloring agent which react with each other on human hair. If a container of the invention is to be used for dispensing an adhesive which is a mixture of an epoxy resin precondensate and a hardener, the necessary changes will be obvious.

It should be understood, therefore, that the foreging disclosure relates only to preferred embodiments of the invention, and that it is intended to cover all changes and modifications of the examples of the invention herein chosen for the purpose of the disclosure which do not constitute departures from the spirit and scope of the appended claims.

What is claimed is:

1. A container comprising:

(a) an elongated shell defining a cavity therein,
  (1) said shell including two substantially cup-shaped parts defining therein respective, corresponding compartments of said cavity,
  (2) each part including two longitudinally terminal, annular portions and a bottom wall adjacent one of said annular portions and remote from the other annular portion,
  (3) the bottom wall of each part bounding a corresponding compartment in one longitudinal direction, and
  (4) the annular portion remote from said bottom wall bounding a side of the corresponding compartment open in the other longitudinal direction;

(b) first and second, substantially planar, frangible membrane members transverse to said longitudinal directions,
  (1) the first membrane member being fixedly sealed to the remote annular portion of one of said parts and closing the open side of the corresponding compartment, whereby said compartments are separated from each other,
  (2) the second membrane member being fixedly sealed to the adjacent annular portion of said one part outside said cavity,
  (3) one of said membrane members being sealed to the remote annular portion of the other part and constituting fastening means fastening said parts to each other;

(c) a piercing member secured to the bottom wall of said one part in said cavity for joint movement,
  (1) said piercing member having a free end portion directed toward said first membrane member,
  (2) said bottom wall of said one part being resiliently movable inward of said cavity a distance sufficient to cause piercing of said first membrane member when said bottom wall of said one part is moved; and (d) releasing means on said shell for directly connecting the compartment defined by the other part to the surrounding atmosphere.

2. A container as set forth in claim 1, wherein said one membrane member essentially consists of a material different from the materials of the two annular portions sealed thereto.

3. A container as set forth in claim 1, wherein said one membrane member constitutes the sole fastening means fixedly fastening said parts to each other.

4. A container as set forth in claim 3, wherein said releasing means include a frangible spout on the bottom wall of said other part.

5. A container as set forth in claim 1, wherein each of said membrane members has at least one face portion of thermoplastic material, said annular portions consist of thermoplastic material, and said at least one face portion of each of said membrane members is heat-sealed to at least one of said annular portions.

6. A container as set forth in claim 5, wherein said one membrane member is said first membrane member, and said compartments are longitudinally juxtaposed.

7. A container as set forth in claim 5, wherein said one membrane member in said second membrane member, said one part being received in the compartment defined by said other part.

8. A container as set forth in claim 1, wherein one of the annular portions sealed to said one membrane member includes a flange, and the other annular portion sealed to said one membrane member is received in said flange.

* * * * *